US006478296B1

(12) United States Patent
Jensen et al.

(10) Patent No.: US 6,478,296 B1
(45) Date of Patent: Nov. 12, 2002

(54) SUPPORTING MEDIA BY BENDING SAME

(75) Inventors: C. Troy Jensen, Caldwell, ID (US); David M. Payne, Star, ID (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/987,935

(22) Filed: Nov. 16, 2001

(51) Int. Cl.[7] ..... B65H 31/00
(52) U.S. Cl. ..... 271/209
(58) Field of Search ..... 271/188, 207, 271/209, 220; 347/104, 218, 264; 399/405, 407, 410

(56) References Cited

U.S. PATENT DOCUMENTS 5,046,717 A * 9/1991 Ettischer et al. ..... 271/220 X
5,478,062 A * 12/1995 Horiuchi et al. ..... 271/220 X
5,810,348 A * 9/1998 Scheufler ..... 271/209 X
6,302,606 B1 * 10/2001 Hayakawa et al. ..... 271/220 X
6,398,213 B1 * 6/2002 Wurschum et al. ..... 271/207 X

* cited by examiner

*Primary Examiner*—David H. Bollinger

(57) ABSTRACT

A post-processing apparatus is configured to substantially support media sheets along their edges by causing the media sheets to substantially bend along their transversely extending axes. Conventional types of media sheets are typically unable to be supported at their edges because they often tend to bend along axially extending axes. According to a sheet handling method, a transversely extending bend is created in the media sheets. In this respect, the media sheets may be supported along their edges without substantially bending along their axially extending axes. In addition, by substantially removing the transversely extending bend in the media sheets, the media sheets are caused to drop substantially straight between a pair of support members. Thus, it is unnecessary to move the support members apart from one another to cause the media sheets to drop between the support members.

19 Claims, 4 Drawing Sheets

SUPPORTING MEDIA BY BENDING SAME

FIELD OF THE INVENTION

This invention relates generally to sheet handling apparatus for image forming devices. More particularly, the present invention pertains to a sheet handling apparatus operable to bend media along a transverse axis to enable support of the media substantially only along transverse edges thereof.

BACKGROUND OF THE INVENTION

It is generally known to stack sheets of media in an apparatus configured to receive sheets upon their exit from an image forming device, e.g., printer, photocopier, facsimile machine, etc. The apparatus is typically operable to perform a plurality of post processing operations on the media sheets. For example, the apparatus may stack, collate, align, group, etc., the sheets following their exit from the image forming device. In addition, the apparatus may also operate to substantially align the edges of the media sheets for binding the sheets together, e.g., staple, fasten, etc. A mechanism for binding the media sheets is often located adjacent to the apparatus to bind the media sheets together. For example, conventional printers oftentimes include a stapler movable from an idle position to a plurality of positions along the sheets for binding the media sheets. In one respect, after a number of media sheets, e.g., a set of sheets, are positioned within the apparatus, the stapler typically moves to a position to apply a staple through the sheets. The stapler then returns to the idle position to enable the media sheets to either be dropped into a storage bin or moved to another area in which the media sheets may be stored.

It is also generally known that media sheets traditionally utilized in image forming devices, e.g., non-reinforced sheets of paper, typically lack rigidity, e.g., media sheets typically lack beam strength. Thus, it is relatively impossible to support traditional types of media sheets solely by their edges because they tend to bend along an axial direction thereof. Consequently, in order to support traditional forms of media sheets, conventional apparatus typically support an entire surface of the media sheets or relatively large portions thereof.

The lack of beam strength in traditional forms of media sheets often causes the methods conventional image forming devices employ to move the media sheets to a storage bin to suffer from a variety of drawbacks and disadvantages. According to one method, a bin is positioned directly beneath a stacker mechanism. In this configuration, the stacker mechanism typically includes a pair of legs for supporting the media sheets along a relatively large portion of a bottom surface of the sheets. The legs are typically movable apart from one another to enable the media sheets to fall down between the legs and into the bin. One problem associated with this method is that the stack dropping may be inconsistent. For example, because the legs are relatively wide and therefore must travel a substantially large distance to enable the media sheets to fall between the legs, it is possible for the media sheets to become skewed due to the friction force between the legs and the media sheets. In addition, because of the relatively large number of moving parts required to cause the media sheets to fall, those devices that implement this type of method are often complex.

According to another known method, a bin is positioned at some distance from the stacker mechanism. In this method, a plurality of rollers are positioned adjacent to or beneath the stacker and generally operate to transport the media sheets from the stacker mechanism to the bin. One problem associated with this method is that there are a relatively large number of moving parts, rendering the devices that employ this method complex. In addition, by virtue of the amount of space required to separately maintain the stacker mechanism, the rollers, and the bin, devices that employ this method often require a relatively large amount of space. Another drawback to these types of devices is that it is often impractical to include all of the above-described components inside of an image forming device.

SUMMARY OF THE INVENTION

According to one aspect, the present invention pertains to a method for handling media sheets. In the method, at least one media sheet having two transversely extending edges and two axially extending edges surrounding a middle portion is received. The at least one media sheet is enabled to bend along a transverse direction during said receiving step. The at least one media sheet is supported by substantially maintaining the bend, whereby the bend operates to increase the beam strength of the at least one media sheet and thereby substantially prevent the at least one media sheet from bending along an axially extending direction.

In accordance with another aspect, the present invention relates to an apparatus for receiving at least one media sheet. The apparatus includes two side support members spaced a distance apart from each other. The side support members are configured to support respective edges of the at least one media sheet. In addition, the side support members have a first section angled with respect to a second section to thereby enable the at least one media sheet to bend along a transverse direction thereof. In this respect, the side support members are configured to support the at least one media sheet substantially only along its edges.

According to yet another aspect, the present invention pertains to a device for forming an image on at least one media sheet. The device comprises an image forming section for forming an image on the at least one media sheet and an output section located substantially downstream of the image forming section. The at least one media sheet may be transported from the image forming section to the output section. The device also includes an apparatus for receiving the at least one media sheet located substantially downstream of the output section. The apparatus includes two side support members spaced a distance apart from each other. The side support members are configured to support respective edges of the at least one media sheet. In addition, the side support members have a first section angled with respect to a second section to thereby enable the at least one media sheet to bend along a transverse direction thereof. In this respect, side support members are configured to support the plurality of media sheets substantially only along their respective edges.

In comparison to known post processing mechanisms, certain embodiments of the invention are capable of achieving certain aspects, including some or all of the following: (1) an apparatus that comprises relatively few components; (2) an apparatus that improves media sheet drop consistency; (3) an apparatus that allows finishing operations with no motion or reduced axis of motion on the finishing device; and (4) an apparatus that does not require a relatively large amount of space. Those skilled in the art will appreciate these and other advantages and benefits of various embodiments of the invention upon reading the following detailed description of a preferred embodiment with reference to the below-listed drawings.

BRIEF DESCRIPTION OF THE DRAWINGS

Features and advantages of the present invention will become apparent to those skilled in the art from the following description with reference to the drawings, in which.

DETAILED DESCRIPTION OF THE INVENTION

For simplicity and illustrative purposes, the principles of the present invention are described by referring mainly to an exemplary embodiment thereof. In the following description, numerous specific details are set forth in order to provide a thorough understanding of the present invention. It will be apparent however, to one of ordinary skill in the art, that the present invention may be practiced without limitation to these specific details. In other instances, well known methods and structures have not been described in detail so as not to unnecessarily obscure the present invention.

According to a preferred embodiment, the present invention pertains to an apparatus for post-processing media sheets. The apparatus is configured to perform various post-processing functions on the media sheets, such as, stacking, edge-aligning, collating, grouping, finishing (e.g., stapling, punching, trimming, gluing, etc.), dropping, and the like. The apparatus performs the above-described functions in a manner that is relatively simple as compared to known post-processing devices. In this respect, the apparatus comprises relatively few moving components by supporting the media sheets along their transverse edges by causing the media sheets to substantially bend along a transversely extending axis.

It is generally known that conventional media sheets are unable to be supported solely at their edges because they tend to bend along an axially extending axis, e.g., due insufficient beam strength. By creating the transversely extending bend in the media sheets, the media sheets may be supported only along their edges without substantially bending along its axially extending axis, e.g., due to a substantial increase in beam strength. In addition, by substantially removing the transversely extending bend in the media, the media is caused to drop substantially along a straight path between a pair of support members. Thus, by operation of an embodiment of the present invention, it is unnecessary to move the support members apart from one another to cause the media to drop from the apparatus, e.g., into a bin located therebelow.

Figure 1:
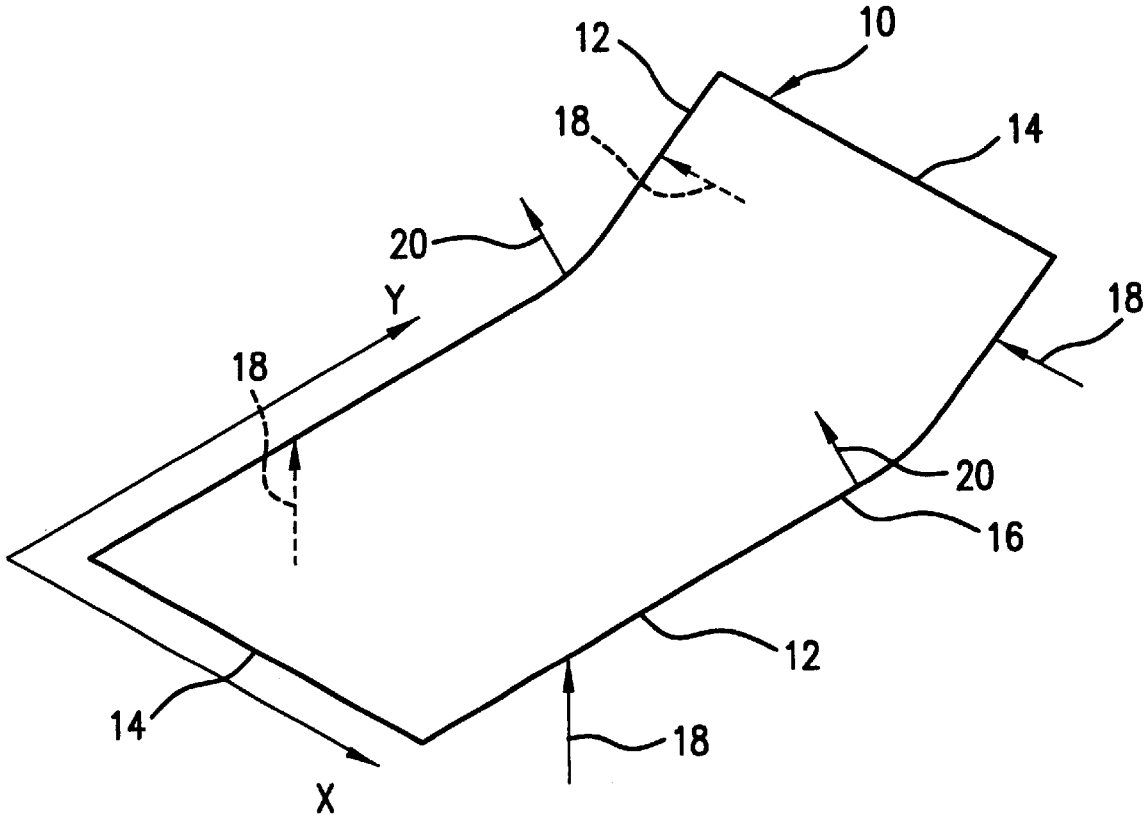
FIG. 1 illustrates a manner in which the principles of the present invention may operate.

FIG. 1 illustrates a manner in which an embodiment of the present invention may be practiced. In FIG. 1, a media sheet 10 is illustrated as consisting of a pair of transversely extending edges 12 and a pair of axially extending edges 14. The transversely extending edges 12 extend generally along a y-axis and the axially extending edges 14 generally extend along an x-axis. In operation, according to a preferred embodiment of the present invention, the media sheet 10 may be fed into an apparatus for post-processing media sheets (not shown) along the y-axis direction. As the media sheet 10 is positioned in the apparatus in this manner, the media sheet 10 is enabled to include an angular portion 16 along the transverse direction along the y-axis of the sheet. In this respect, the angular portion 16 forms a bend along the transversely extending direction (y-axis) of the media sheet 10.

The bend is considered to extend along the transversely extending direction (y-axis) because the bend causes the transversely extending edges 12 to be bent. In a similar manner, the bend may be considered to extend along the axially extending direction (x-axis) because the bend extends along the same direction as the axially extending edges 14. For purposes of simplicity and consistency, the angular portion 16, and thus the bend, will be considered to extend along the transversely extending direction (y-axis) throughout the present disclosure. It should be understood that the terminology utilized in the present disclosure is not meant to limit the present invention in any respect, rather, the manner in which the aspects of the present invention are described are for simplicity of description and illustration only. Therefore, it is not relevant to the present invention to consider the bend as extending along either the transversely extending or axially extending directions.

By virtue of the angular portion 16, the media sheet 10 may be supported at its transversely extending edges 12 as indicated by arrows 18, which indicate the supports for supporting the media sheet 10. In one respect, the media sheet 10 may possess a substantially larger level of beam strength by formation of the angular portion 16. The arrows 20 indicate a manner in which the angular portion 16 may be reduced or removed to thus substantially reduce or remove the beam strength of the media sheet 10. Reduction or removal of the beam strength enables a middle portion of the media sheet 10 to bow by the force of gravity. The bowing may cause the media sheet 10 to bend along an axially extending direction (x-axis), thereby reducing the distance between the transversely extending edges 12 of the media sheet. One result of the reduction in distance between the edges 12 is that the supports indicated by the arrows 18 may no longer be sufficient to support the media sheet 10. Thus, when the angular portion 16 is reduced or removed, the media sheet 10 may fall in a substantially free manner from the supports indicated by the arrows 18.

In addition, the media sheet 10 may be released from the supports indicated by arrows 18 without requiring that the supports be moved apart from each other in the x-axis direction. In this respect, the media sheet 10 may be released from the apparatus in a relatively simple manner with a substantially minimal amount of moving parts. Moreover, the media sheet 10 may be released without suffering from the drawbacks and disadvantages associated with known post-processing apparatus.

Figure 2:
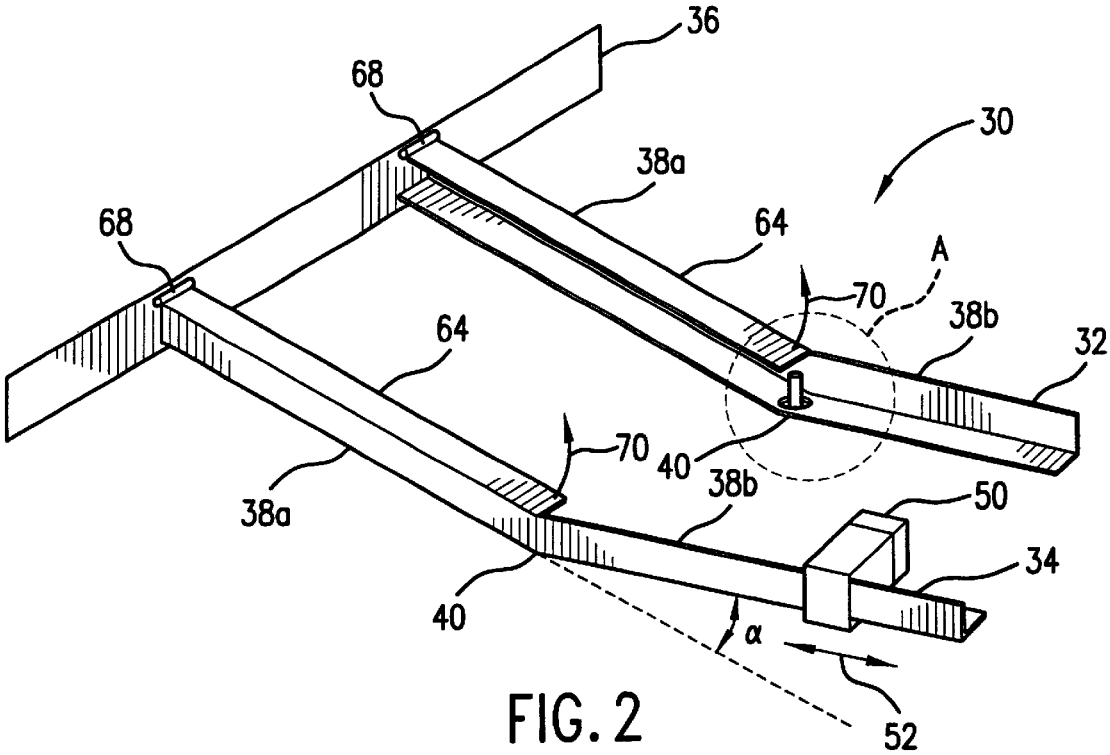
FIG. 2 illustrates a simplified post-processing apparatus in accordance with an embodiment of the present invention.

FIG. 2 illustrates a simplified perspective view of a post-processing apparatus 30 through which a preferred embodiment of the present invention may be practiced. The apparatus 30 may include a pair of generally L-shaped support members 32 and 34. At least one of the support members 32 and 34 may be configured for movement along a base member 36 to enable a space between the support members 32 and 34 to be modified in order to accommodate media sheets 10 of various widths. Each of the support members 32 and 34 includes a first section 38*a* and a second section 38*b*. The first sections 38*a* generally extend perpendicularly from the base member 36. The selection of the lengths of each section 38*a* and 38*b* may be based upon a plurality of factors, such as, the length of media to be stacked between the support members 32 and 34, the rigidity of the media, etc. The second sections 38*b* are angled with respect to the first sections 38*a* at a joint 40. The angle (α) may also be selected according to a plurality of factors. These factors may include, media length, media density, etc. For example, for media having average density and length, the angle (α) may comprise about 10 to 20 degrees and preferably approximately 17 degrees.

Moreover, the angle (α) may vary according to the stiffness of the media to be supported by the apparatus 30. In this respect, media possessing a relatively large stiffness may require a apparatus 30 having a relatively smaller angle than one possessing a relatively lesser stiffness. In one respect, the angle (α) may be set by optimizing a plurality of factors involved in the stacking of sheets of media. For example, those factors may include the ease with which the media may rest on top of the support members 32 and 34, the amount of bend applied on the media to enable it to possess a sufficient amount of beam strength, etc.

The apparatus 30 may include a finishing device 50, e.g., stapler, jogger, hole puncher, etc., here shown as being attached to one of the support members 34. As indicated by arrow 52, the finishing device 50 generally travels along the support member 34 but may be relatively fixed with respect to the perpendicular direction of extension of the support members 32, 34. In this respect, the finishing device 50 may operate to perform finishing operations on the media sheets at various locations upon the media sheets. In addition, the media sheets may be dropped from the apparatus 30 without requiring the finishing device 50 first be moved in a direction generally away from the media sheets. Although FIG. 2 illustrates the finishing device 50 as being attached to the support member 34, it should be understood that the finishing device 50 may be attached to any reasonably suitable structure, e.g., an image forming device, post-processing device, etc., without departing from the scope and spirit of the present invention.

According to a preferred embodiment of the invention, bending devices 64 may be spaced generally above a bottom surface of the support members 32 and 34. The bending devices 64 may assist in the bending of the media sheets as they are received by the apparatus 30. In addition, the bending devices 64 may operate to maintain the bend in the media sheets while the sheets are positioned in the apparatus 30. As indicated by the arrows 70, the bending devices 64 are configured to rotate about a pair of hinge members 68. By operation of rotating the bending devices 64 as indicated by the arrows 70, the bend in the media sheets located in the apparatus 30 may be substantially reduced, thereby enabling the media sheets to fall between the support members 32 and 34.

Figure 3:
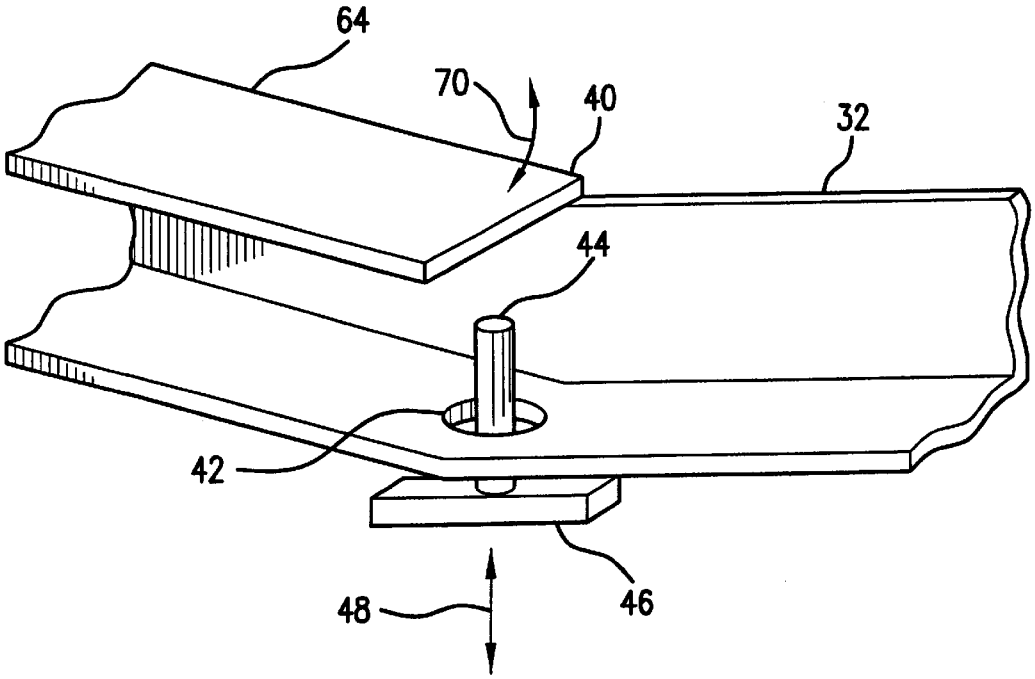
FIG. 3 illustrates an enlarged view of a movable member of the apparatus shown in FIG. 2.

Referring now to FIG. 3, there is illustrated an enlarged view of the joint 40 located between the first and second sections 38*a* and 38*b* of the support member 32. According to a second preferred embodiment of the invention, an aperture 40 is located substantially adjacent the joint 40. A protruding member 44 is provided such that a portion of the protruding member may extend through the aperture 40 above a leg of the support member 32. A drive mechanism 46 is provided to manipulate the protruding member 44 vertically as indicated by the arrow 48. The drive mechanism 46 may comprise any reasonably suitable device for manipulating the protruding member 44, e.g., a hydraulic pump, a system of gears powered by a DC motor, solenoid, piezo actuator, and the like. In addition, the drive mechanism 46 may be operated by a control system of an image forming device. Furthermore, it should be understood that the protruding member 44 may be manually operated by a user without deviating from the scope and spirit of the present invention. Moreover, the drive mechanism 46 may be configured to operate the hinging movement of the bending devices 64. That is, as the protruding member 44 is operated to move in the direction 48, the bending devices 64 may correspondingly be operated to move in the direction 70.

Once the media sheets have been post-processed in the apparatus 30, the protruding member 44 is caused to protrude through the aperture 42 by operation of the drive mechanism 46. As the protruding member 44 extends through the aperture 42, the protruding member may substantially contact the media sheets substantially along the transverse bend formed by virtue of the bend in the support members 32 and 34. Once the protruding member 44 has extended certain distance, the bend along the media sheets may become substantially lessened. As described hereinabove with respect to FIG. 1, once the bend is substantially lessened, the beam strength in the media sheets is substantially reduced, thereby causing a substantially central portion of the media sheets to bend along an axial direction. By virtue of the bend along the axial direction, the distance between the transversely extending edges of the media sheets may be reduced, thereby enabling the media sheets to fall between the support members 32 and 34. Because the stacks of media sheets are caused to fall in the above-described manner, the stacks of media sheets may be stacked in the bin in a substantially straighter configuration than is possible with known media stacking devices.

Although FIGS. 2 and 3 illustrate one of the support members 32 as including an aperture 42, protruding member 44, and drive mechanism 46, it is within the purview of the present invention that these components may be included in the other support member 34 without deviating from the scope and spirit of the present invention. In addition, it should be understood that an upper surface of the protruding member 44 may be situated below the leg of the support member 32 when the stacker 30 receives the sheets of media.

Figure 4:
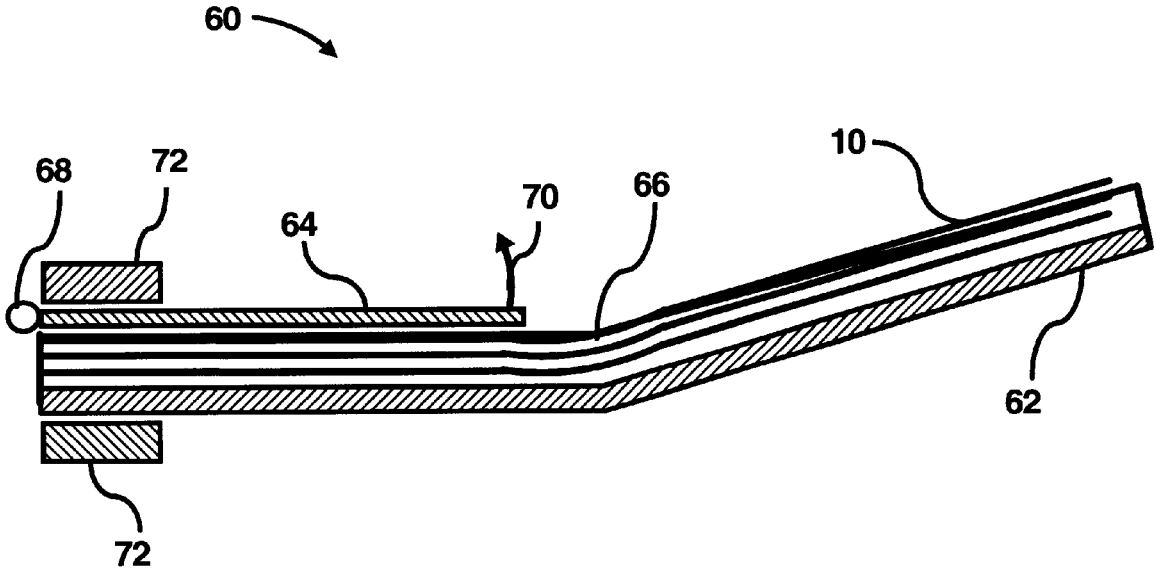
FIG. 4 illustrates a simplified side cross-sectional view of a post-processing apparatus according to another embodiment of the present invention.

In FIG. 4, there is illustrated a simplified side cross-sectional view of another post-processing apparatus 60 embodying an alternative manner in which a preferred embodiment of the present invention may be practiced. Although only one side of the apparatus 60 is shown, the apparatus may include a pair of generally L-shaped support members 62. At least one of the support members 62 may be configured for movement along a base member (not shown) to enable a space between the support members 62 to be modified in order to accommodate media sheets 10 of various widths. The widths of the support members 62 may be relatively small compared to the width of the apparatus 60. Suitable widths for the support members 62 may range from about 0.25 inches to about 2 inches. By virtue of the relatively small widths, the support members 62 may be configured to support media sheets 10 substantially only at their transversely extending edges 12. Therefore, in comparing the manner in which the media sheets 10 are supported in FIG. 4 with the illustration in FIG. 1, it may be seen that the support members 62 are configured to support the media sheet 10 at those positions indicated by arrows 18.

The apparatus 60 also includes at least one bending device 64 for assisting in the bending of the media sheets 10 as they are received by the apparatus. The media sheets 10 positioned in the apparatus 60 possess a bend 66 along a transversely extending direction thereof that may be formed by operation of the bending device 64. In one respect, the media sheets 10 may tend to retain a relatively flat configuration along the transversely extending direction. Therefore, the bending device 64 may operate to cause the bend 66 to be formed in the media sheets 10. The bending device 64 may be hinged along a pivot 68 to thereby enable the bending device 64 to engage and disengage from the media sheets 10. The media sheets 10 may be released from the apparatus 60 by pivoting of the bending device 64 along the pivot 68 in a direction indicated by the arrow 70. Pivoting the bending device 64 in this manner generally enables the media sheets 10 to substantially straighten, i.e., the bend 66 is reduced or removed. Once the bend 66 is reduced or removed, the media sheets 10 may naturally bend along an axially extending direction, thereby causing the media sheets 10 to drop between the support members 62.

The apparatus 60 further includes a finishing device 72 for performing finishing operations on the media sheets 10. The finishing operations may include performance of stapling, punching, trimming, adhering, and the like, on the media sheets 10. The finishing device 72 may be configured to travel along an axially extending direction of the media sheets 10, i.e., in FIG. 2, substantially into and out of the plane of the figure. The finishing device 72 may also be configured to be substantially fixed with respect to an axially extending direction of the media sheets 10 during performance of the finishing operation as well as during the release of the media sheets 10. In addition, the media sheets 10 may be released from the apparatus 60 by reducing or removing the bend 66 in the above-described manner while maintaining the finishing device 72 in a substantially fixed position with respect to the support member 52, for example. Therefore, because no time is taken to move the finishing device 72, the present invention may be able to perform post-processing operations in a relatively shorter amount of time as compared to known post-processing apparatus. In addition, the present invention may be able to perform post-processing operations in a simple manner, e.g., with relatively little movement by the apparatus 60 and/or the finishing device 72, as compared to known post-processing apparatus.

Although specific reference is made to the apparatus 30, 60 as operating to receive individual sheets of media, it is within the purview of the present invention that the apparatus may also operate to receive stacks of media sheets without deviating from the scope and spirit of the present invention. Thus, a plurality of media sheets may be post-processed prior to being fed in to t he apparatus 30, 60.

In addition, although reference is made to specific examples of apparatus 30 and 60 that may be implemented to practice a preferred embodiment of the present invention, it should be understood that any number of reasonably suitable apparatus may be implemented to practice the embodiment illustrated in FIG. 1.

The apparatus 30 and 60 may be configured for attachment to an output section of an image forming device (not shown). Examples of suitable image forming devices may include, printers, copiers, facsimile machines, and the like. In addition, the apparatus 30 and 60 may be positioned within the image forming device in such a manner as to obviate the need for a substantially large space around the image forming device.

Figure 5:
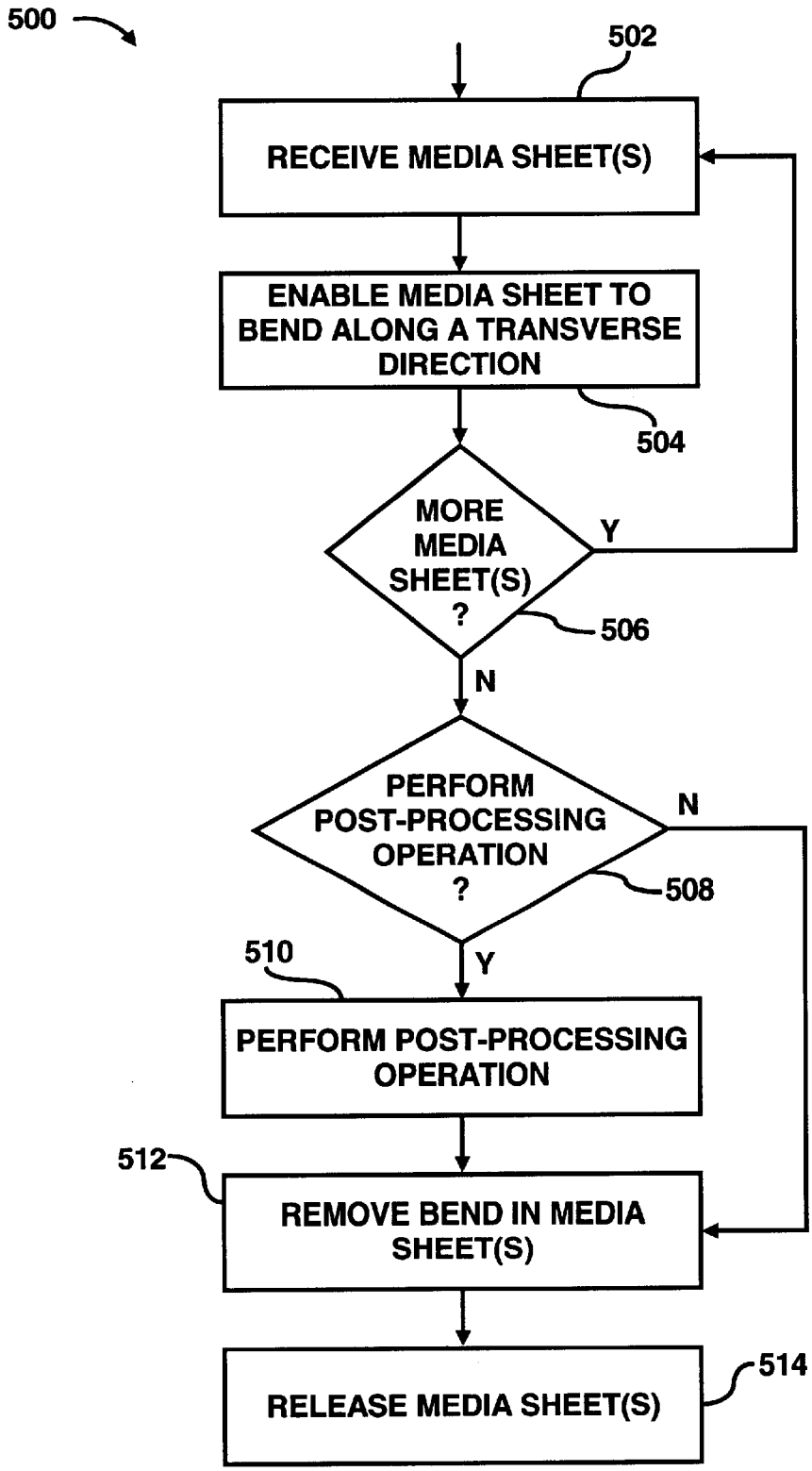
FIG. 5 illustrates a flow diagram showing a manner in which an embodiment of the present invention may be practiced.

In FIG. 5, there is illustrated an exemplary flow diagram 500 depicting a manner in which a preferred embodiment of the present invention may be practiced. At step 502, a media sheet(s) having two transversely extending edges and two axially extending edges surrounding a middle portion is received by a post-processing apparatus. At step 504, the media sheet(s) is enabled to bend along a transverse direction during step 502. In this respect, by way of example, the bend in the media sheet(s) may be enabled by operation of the apparatus 30, 60 illustrated in FIGS. 2 and 4, respectively. It should be understood, however, that the bend may be enabled in any other reasonably suitable manner. The media sheet(s) is supported by the apparatus by substantially maintaining the bend. In this regard, as described in greater detail hereinabove, the bend generally operates to increase the beam strength of the media sheet(s) and thereby substantially prevents the media sheet(s) from bending along an axially extending direction.

By substantially preventing the media sheet(s) from bending along an axially extending direction, the media sheet(s) may be supported substantially solely along its transversely extending edges.

At step 506, it may be determined whether an additional media sheet(s) is to be received by the apparatus. If an additional media sheet(s) is to be received, steps 502 and 504 may be repeated. Steps 502 and 504 may be repeated as many times is necessary to complete, for example, a set of printed media sheets. If no additional media sheets are to be received in the current set of media sheets, it may be determined whether a post-processing operation, e.g., aligning, collating, grouping, stapling, binding, punching, trimming, etc., is to be performed on the media sheet(s) at step 508. The determination of whether a post-processing operation is to be performed on the media sheet(s) may be based upon user preferences and may thus vary between various printing operations.

If it is determined that the performance of a post-processing operation is required, a post-processing operation may be performed as indicated at step 510. The post-processing operation may be performed on the media sheet (s) by operation of a finishing device. By way of example, as described hereinabove and illustrated in FIG. 4, the finishing device may operable to travel along an axially extending direction of the media sheet(s). In addition, the finishing device may be maintained in substantially fixed manner along a transversely extending direction of the media sheet(s) during performance of the finishing operation. Thus, it is not required to maneuver the finishing device to an operating position with respect to the media sheet(s).

If a post-processing operation is not required at step 508, or after the performance of a post-processing operation, the bend in the media sheet(s) maybe reduced or removed at step 512, thereby releasing the media sheet(s) from the apparatus as indicated at step 514. The manner in which the bend is reduced or removed in the media sheet(s) may vary according to various implementations of the preferred manner of practicing the present invention. Examples of suitable manners are illustrated in FIGS. 2 and 4. It is to be understood that the exemplary manners of reducing or removing the bend illustrated in FIGS. 2 and 4 are for illustrative purposes only and are thus not meant to limit the present invention in any respect.

During the release of the media sheet(s), it is unnecessary to reposition the finishing device along a transversely extending direction with respect to the media sheet(s). In this regard, additional time is not required to release the media sheet(s).

According to certain embodiments of the present invention, media sheets may be post-processed and released with relatively minimal amount of movement by a post-processing apparatus. In addition, the media sheets may be finished without requiring that a finishing device be maneuvered in a transverse direction at any time before, during or after performance of the finishing operation. In this respect, the manner of operation of the post-processing apparatus according to certain embodiments of the present invention is relatively simple compared to known post-processing apparatus. Moreover, by virtue of the relatively simple operation of certain embodiments of the present invention, an apparatus configured to perform the post-processing operations may be configured to only require a relatively small amount of space in an image forming device.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims—and their equivalents—in which all terms are meant in their broadest reasonable sense unless otherwise indicated.

What is claimed is:

1. A method for handling media sheets, said method comprising:

receiving at least one media sheet having two transversely extending edges and two axially extending edges surrounding a middle portion;

enabling said at least one media sheet to bend along a transverse direction during said receiving step; and supporting said at least one media sheet by substantially maintaining said bend, whereby said bend operates to increase the beam strength of said at least one media sheet and thereby substantially prevent said at least one media sheet from bending along an axially extending direction;

wherein said supporting step further comprises supporting the two transversely extending edges with a pair of side support members, such that said middle portion is substantially unsupported.

2. The method according to claim 1, further comprising substantially removing said bend along said transverse direction and releasing said at least one media sheet.

3. The method according to claim 2, further comprising maintaining said side support members in substantially fixed positions with respect to each other during said step of removing said bend along said transverse direction and releasing said at least one media sheet.

4. The method according to claim 1, further comprising receiving a plurality of media sheets.

5. The method according to claim 4, wherein said step of receiving said plurality of media sheets comprises accumulating said plurality of media sheets.

6. The method according to claim 5, wherein said step of accumulating said plurality of media sheets comprises performing one or more of aligning, collating and grouping said plurality of media sheets.

7. The method according to claim 1, further comprising performing a finishing operation with a finishing device on said supported at least one media sheet.

8. The method according to claim 7, wherein said step of performing said finishing operation comprises binding said at least one media sheet to another supported media sheet.

9. The method according to claim 7, wherein said finishing device is operable to move along an axial direction of said at least one media sheet and is substantially fixed along a transverse direction of said at least one media sheet, and wherein said step of performing said finishing operation comprises maintaining said finishing device in a substantially fixed positioned with respect to said transverse direction of said at least one media sheet.

10. The method according to claim 1, further comprising releasing said at least one media sheet.

11. The method according to claim 10, wherein said step of releasing said at least one media sheet comprises removing said bend along said transverse direction.

12. The method according to claim 11, wherein said step of releasing said at least one media sheet comprises maintaining a pair of side support members in substantially fixed positions with respect to each other during said step of removing said bend along said transverse direction and releasing said at least one media sheet.

13. The method according to claim 10, further comprising performing a finishing operation with a finishing device on said supported at least one media sheet prior to said step of releasing said at least one media sheet.

14. The method according to claim 13, further comprising maintaining said finishing device at a substantially fixed location with respect to said transverse direction of said at least one media sheet during both said finishing operation and said step of releasing said at least one media sheet.

15. An apparatus for receiving at least one media sheet, said apparatus comprising:

two side support members spaced a distance apart from each other, wherein said side support members are configured to support respective edges of said at least one media sheet; and said side support members having a first section angled with respect to a second section to thereby enable said at least one media sheet to bend along a transverse direction thereof, wherein said side support members are configured to support the at least one media sheet substantially only along its edges.

16. The apparatus according to claim 15, further comprising:

a finishing device located substantially adjacent to said two side support members, wherein said finishing device is operable to move substantially parallel to a direction of extension of two side support members and is substantially fixed with respect to a perpendicular direction of extension of said two side support members.

17. The apparatus according to claim 15, further comprising:

means for removing said bend in said at least one media sheet to thereby cause said at least one media sheet to be released from said side support members.

18. A device for forming an image on at least one media sheet, said device comprising:

an image forming section for forming an image on said at least one media sheet;

an output section located substantially downstream of said image forming section, wherein said media sheet may be transported from said image forming section to said output section;

an apparatus for receiving said at least one media sheet located substantially downstream of said output section;

said apparatus including two side support members spaced a distance apart from each other, wherein said side support members are configured to support respective edges of said at least one media sheet; and said side support members having a first section angled with respect to a second section to thereby enable said at least one media sheet to bend along a transverse direction thereof, wherein said side support members are configured to support the at least one media sheet substantially only along its edges.

19. The device according to claim 18, further comprising: means for removing said bend in said at least one media sheet to thereby cause said at least one media sheet to be released from said side support members.

* * * * *